United States Patent [19]

Szczypiorski

[11] Patent Number: 4,972,900

[45] Date of Patent: Nov. 27, 1990

[54] PERMEABLE NOZZLE METHOD AND APPARATUS FOR CLOSED FEEDING OF MOLTEN METAL INTO TWIN-BELT CONTINUOUS CASTING MACHINES

[75] Inventor: Wojtek Szczypiorski, Colchester, Vt.

[73] Assignee: Hazelett Strip-Casting Corporation, Colchester, Vt.

[21] Appl. No.: 426,096

[22] Filed: Oct. 24, 1989

[51] Int. Cl.[5] ..... B22D 11/06; B22D 11/10

[52] U.S. Cl. ..... 164/481; 164/437; 164/488; 222/591

[58] Field of Search ..... 164/481, 488, 420, 437, 164/439; 222/603, 591

[56] References Cited

U.S. PATENT DOCUMENTS

| | | | |
|---|---|---|---|
| 3,430,683 | 3/1969 | Hood | 164/428 |
| 4,593,742 | 1/1986 | Hazelett et al. | 164/415 |
| 4,605,594 | 8/1986 | Owens et al. | 428/373 |
| 4,619,309 | 10/1986 | Huber et al. | 164/437 |
| 4,648,438 | 3/1987 | Hazelett et al. | 164/475 |
| 4,752,515 | 6/1988 | Hosoi et al. | 428/300 |
| 4,770,935 | 9/1988 | Yamamura et al. | 428/366 |
| 4,811,781 | 3/1989 | Romanowski et al. | 164/437 |
| 4,830,089 | 5/1989 | Carmichael et al. | 164/481 |

OTHER PUBLICATIONS

Communication from Assignee, Hazelett Strip-Casting Corporation, as set forth in the accompanying Information Disclosure Statement.

*Primary Examiner*—Richard K. Seidel
*Assistant Examiner*—Rex E. Pelto
*Attorney, Agent, or Firm*—Parmelee, Bollinger & Bramblett

[57] ABSTRACT

Method and apparatus for the feeding of molten metals through nozzles having gas-permeable walls, cooperating with twin-belt continuous metal-casing machines. The closed-channeled, multi-passaged nozzles have gas-permeable refractory walls, allowing the escape of gases that may be dissolved in the molten metal and become expelled or liberated from it while the molten metal is flowing through the passageways in the nozzle. Gaseous voids in the continuously cast product are thereby avoided, notably in aluminum casting as shown by experimental results to date. The nozzles are made from gas-permeable refractory material having interconnected porosity—that is, interconnected void interstices—extending through the nozzle walls. The interconnected void interstices are of sufficient size for allowing the passage of hydrogen gas through the walls, while being sufficiently small for preventing the leakage of molten metal. The gas-permeable refractory material is relatively non-wettable by the molten metal. For example, the nozzles are made of fibrous sintered refractory material—for instance, fibers of alumina or silica intertwined and cohered within a major volume-percentage of interstitial voids, which provide the interconnected porosity. Such fibrous material displays high resistance to thermal shock. It is relatively compliant to nozzle clamps, with consequent resistance to breakage, while the coefficients of thermal conductivity and thermal expansion of such fibrous refractory material are advantageously low.

20 Claims, 5 Drawing Sheets

PERMEABLE NOZZLE METHOD AND APPARATUS FOR CLOSED FEEDING OF MOLTEN METAL INTO TWIN-BELT CONTINUOUS CASTING MACHINES

BACKGROUND

It is highly desirable to feed most molten metals into any casting arrangement in such a manner that there is minimal contact with an uncontrolled atmosphere. To accomplish this protection of the molten metal from an uncontrolled atmosphere in twin-belt continuous casting, the caster is set up for "closed feeding," a term which includes both closed-pool feeding and injection feeding. Specific features of these latter two techniques are not germane here but are explained in U.S. Pat. Nos. 4,593,742 and 4,648,438, both of which are assigned to the same assignee as the present application. The synonymous terms "closed feeding" or "closed metal feeding" or "closed casting" do not mean entire sealing (air-tight sealing) of the upstream or feeding end of the moving mold cavity defined between the two moving belts, but rather such terms mean substantially blocking the entrance of the moving mold cavity by a metal-feeding nozzle with respective clearances around the nozzle in a range roughly up to about 0.050 of an inch (about 1.27 mm). Usually the clearances around the nozzle are less than that figure, as discussed in the referenced patents. Closed metal feeding is always used for twin-belt casting of aluminum, and it is also used where feasible in such continuous casting of slab of any metal having a melting point higher than that of zinc.

In the continuous casting of, say, aluminum between endless flexible metallic casting belts, a metal-pouring nozzle comprising multiple channels of closed cross-section is generally used to conduct the molten aluminum into the twin-belt casting machine. Such a nozzle having channels (feeding passageways) of closed cross-section protects the molten metal from oxidation and undue heat loss, which would be caused by contact with ambient air and which otherwise would occur, if open runners were used. To protect the molten metal from ambient air, the prior art has used closed conduits made of refractory materials, often ceramics, the walls of which have not been permeable to gas. It has generally been assumed heretofore that such gas-nonpermeability was very desirable in the twin-belt continuous casting of molten metals, since oxidation of molten metals is a common problem in casting operations.

This gas-impermeability of the molten-metal-feeding nozzle is especially advantageous, for instance, when casting molten steel, where uncontrolled atmospheric contact results in the formation of unwanted oxides and nitrides. The steel industry has taken pains to develop impervious conduit materials. The impermeability of prior-art nozzle materials has been turned to further advantage by conducting inert shielding gases directly into the casting area through long holes drilled in nozzles made of such impervious materials, as taught in U.S. Pat. Nos. 4,593,742 and 4,648,438 relating to inert gas shrouding apparatus and methods.

For the purpose of excluding atmospheric gases, the prior art known to me for closed metal feeding of twin-belt continuous casting machines has always incorporated metal-feeding snouts or nozzles that were practically impermeable to gas. A typical material for the refractory nozzles in the prior art of twin-belt continuous casting of aluminum has been a baked clay that contains asbestos or, more recently, compressed and mildly baked calcium silicate. Although such impermeable refractory nozzles enabled the twin-belt casting of aluminum to develop to a high state of usefulness, some problems remained.

Such dense, non-permeable refractories have always suffered from certain drawbacks, notably brittleness and inflexibility. For example, prior experiments were made with non-permeable ceramics. Fired ceramic nozzles have been apt to crack when a minutely warped nozzle was clamped into position for casting. Surface grinding of the broad faces of the ceramic nozzles was tried in order to get rid of the warp caused by firing, but micro-cracks would develop upon grinding, resulting in reduced strength and reduced thermal shock resistance under the conditions of service. Even without a detectable initial warp, cracking was apt to occur in non-permeable ceramic nozzles due to uneven thermal expansion and the consequent tendency to warp. Interrupting with shallow grooves the outer broad surfaces of ceramic or other solid earthenware nozzles reduced troublesome thermal stresses and cracking of nozzles but has not been a sufficient solution to the problems which remained.

A very troubling problem with nozzles made from non-permeable materials and used for feeding molten aluminum into twin-belt casters has been the mysterious occurrence of gross voids in the continuously cast metallic slab product.

It became my theory that entrained gas caused these gross void spaces, which measured on the order of $\frac{1}{4}$ inch (6 millimeters) in diameter. Subsequent rolling of such cast slab containing such voids would result in corresponding perforations appearing in the rolled, thin, sheet strip.

I had the theory first that the gas causing such voids came from the nozzle material itself, and some of it did. Some nozzle materials contained carbonate or hydrate that would break down at high temperature and evolve gas. Such gas evidently became entrained in the flow of molten metal, coalescing into large bubbles, and so moved downstream in the freezing product, where the voids were later found. Usually they were just under the upper surface of the cast slab, sealed usually with a thin film of aluminum that was level with the top surface of the cast slab.

In order to get rid of the entrained gas, thorough preheating and consequent outgassing of impermeable refractory nozzles was tried. Such outgassing of non-permeable nozzles prior to their use improved the situation. However, intense prior baking and outgassing of such nozzles, even in a vacuum, consistently failed to stop the formation of mysterious gross voids, despite tests with many formulations and grades of non-permeable nozzle material.

The mysterious voids kept on appearing, as just described. I then began to suspect that some other source was introducing gas into the molten metal flowing downstream into the moving mold region between the two moving belts.

It is known in aluminum metallurgy that molten aluminum and its alloys often contain dissolved hydrogen and moreover the surprising fact that the solubility of this hydrogen in the aluminum decreases with decreasing temperature. It became relevant to my theory to note that in twin-belt continuous casting of aluminum, the nozzle does not receive external heat. Thus, I reasoned that the temperature of the molten aluminum must have decreased as it traversed the passages of the non-permeable nozzle. I carefully observed and repeatedly noted that the inner surfaces of the aforementioned sealed gross voids in the cast aluminum product were always shiny. If the troublesome gases had contained oxygen, as the earth's atmosphere does, I would expect such inner void surfaces to be noticeably oxidized to a dull, non-shiny appearance. Such a non-shiny appearance was not the case; consequently I concluded that the offending gases did not contain much oxygen.

Since outgassing of non-permeable nozzles even in a vacuum did not solve the problem of the mysterious gross voids, and since my careful repeated inspection of the walls of such voids revealed them to be shiny, it became my theory that the above facts pointed to another non-atmospheric source of the remaining gas in the gross voids. I suspected hydrogen to be the offending gas, coming from the molten aluminum itself. In this theory, I concluded that the offending gas was expelled from solution during travel of the molten aluminum through the nozzle, rather than later. In addition to the temperature drop occurring in the nozzle, it may be that turbulence (such as I believe to exist in the nozzle passages) contributes to the separation (liberation) of the dissolved gas from the molten aluminum.

In summary, the facts suggested to me a theory that the offending gas is hydrogen and that it is released from the molten aluminum while it is flowing through the nozzle, such release of hydrogen possibly being augmented by turbulent flow through the nozzle passages.

In order to test wider applicability of my theory, an associate poured molten copper through non-permeable quartz (fused silica) tubes. Voids appeared on the upper surface of the cast product in the form of black streaks of bubbles. This lone experiment suggests that aluminum is not the only metal incurring the problem here considered.

SUMMARY OF THE DISCLOSURE

To this day, the above-developed theory that the liberation of hydrogen gas within the passageways of non-permeable nozzles is the cause of the formation of gross voids in the twin-belt casting of aluminum has not been proven beyond any possible doubt. This theory nevertheless received a strong confirmation when it led me to the discovery that the employment of casting snouts or nozzles fashioned of gas-permeable materials eliminated the above-described problem of gross voids. Suitable gas-permeable materials were sought and found. The use of some of them resulted in the immediate and thorough elimination of the problem of gross voids. The additional inference here is that the permeability of the walls of the snout or nozzle allows the evolving hydrogen gas to escape, instead of coalescing and becoming entrained in the flow and hence becoming trapped in the frozen product. The strength of the confirmation of this theory arises from the fact that it was the prior existence of this theory that emboldened the successful search to find a suitable permeable material for a metal-pouring nozzle (in spite of the prior-art view that non-permeability of the nozzle was very desirable in twin-belt continuous casting).

Moreover, suitable gas-permeable refractory nozzle materials also have advantageously eliminated or have substantially overcome the above-described brittleness, inflexibility and cracking problems occurring with prior-art non-permeable nozzles.

BRIEF DESCRIPTION OF THE DRAWINGS

The invention, together with further objects, aspects, advantages and features thereof, will be more clearly understood from a consideration of the following description in conjunction with the accompanying drawings, in which like elements will bear the same reference designations throughout the various Figures. Open arrows drawn therein indicate the direction of movement of the metal being fed into the moving mold and being cast therein in a direction from upstream to downstream, the metal being fed into the upstream end of the continuously moving mold. The drawings are not necessarily drawn to scale, emphasis instead being placed upon clearly illustrating the principles of the invention.

DESCRIPTION OF THE PREFERRED EMBODIMENT

Figure 1:
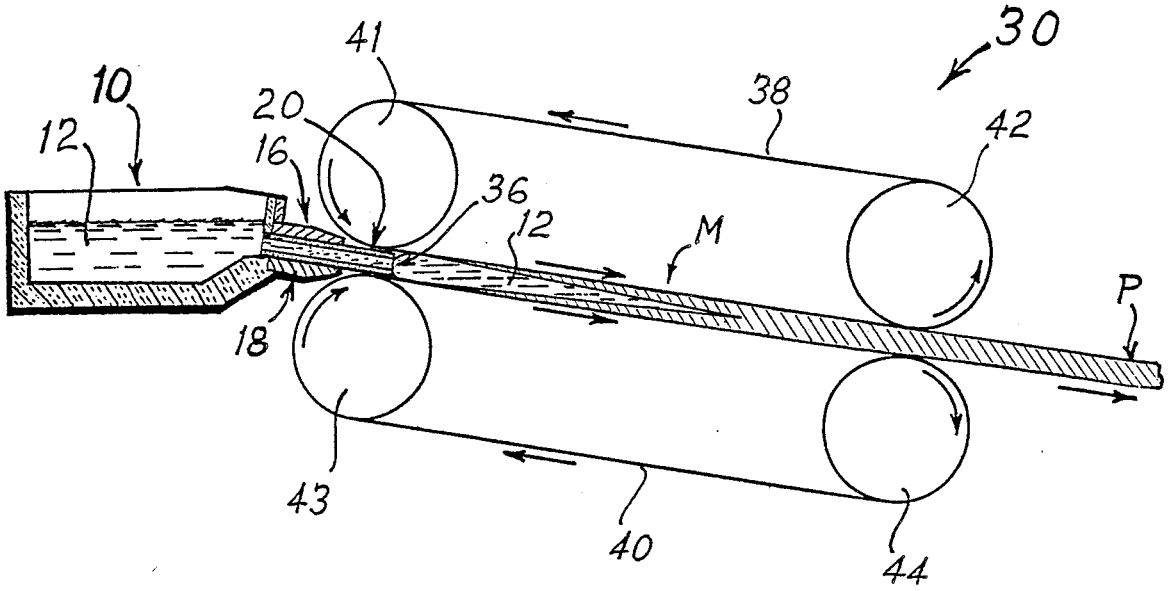
FIG. 1 is a side elevational diagram of a twin-belt continuous casting machine.
Figure 2:
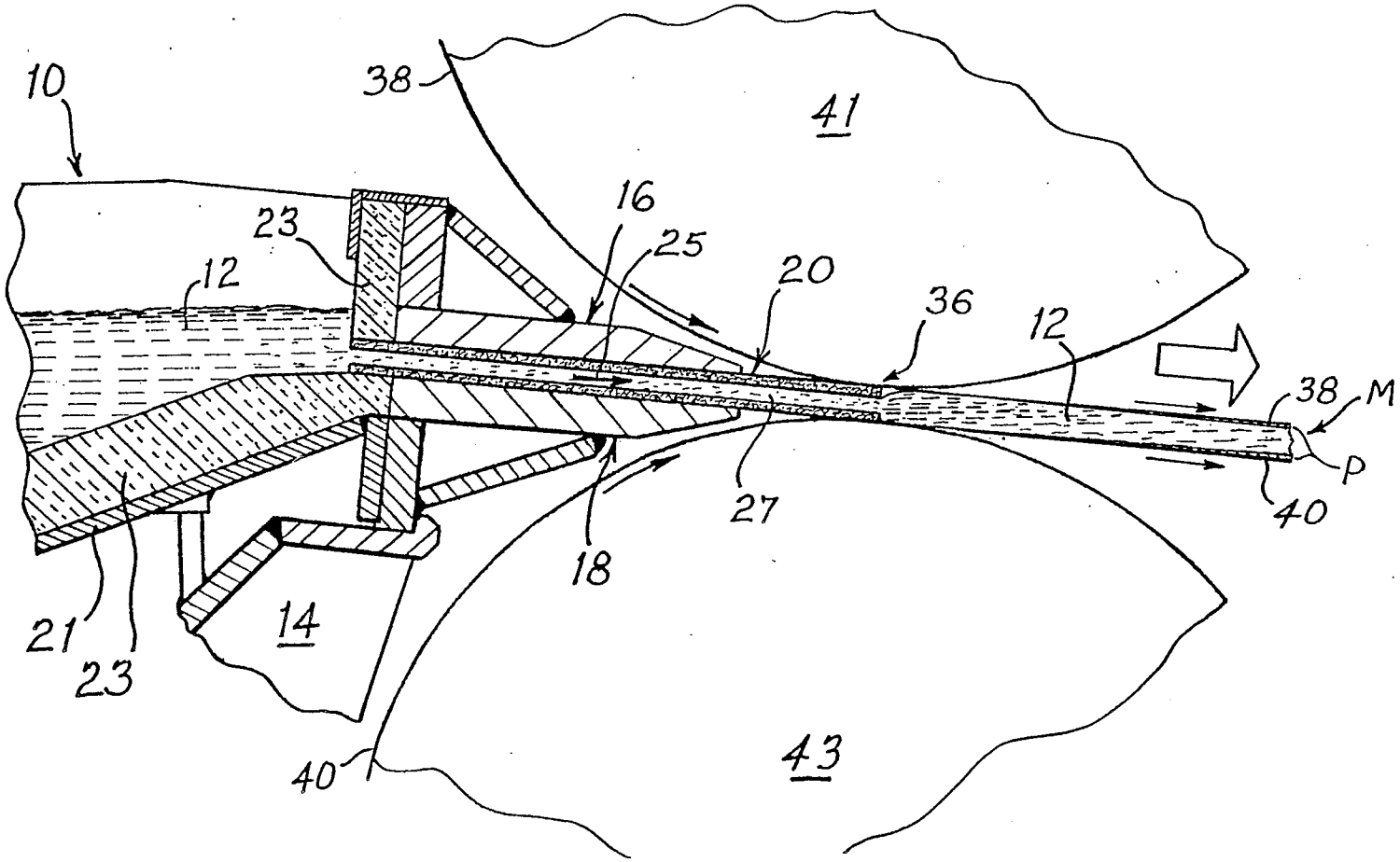
FIG. 2 is a side elevational cross-section view of a molten-metal feed nozzle and mold entrance (upstream end) of a twin-belt continuous metal-casting machine set up for "closed metal feeding," embodying the present invention.

As an example of the presently preferred best mode of employment of this invention, a typical twin-belt continuous metal-casting machine is used. FIG. 1 is a side elevational diagrammatic view of a twin-belt continuous caster. Such a twin-belt continuous caster is shown in detail in U.S. Pat. Nos. 4,593,742 and 4,648,438, in FIG. 2 therein. The reader is referred to the disclosures of these two patents if the reader wishes to know more of the details about a typical twin-belt continuous caster.

Referring now to FIGS. 1, 2, 3 and 4 herein, the twin-belt continuous caster is set up for "closed metal feeding" as discussed in the Background above. A tundish 10 contains molten metal 12. The tundish 10 rests on a supporting fixture 14 which, together with the tundish, is discussed in more detail in the referenced U.S. patents. Upper nosepiece 16 and lower nosepiece 18 serve for clamping a gas-permeable nozzle 20 between them. The upper and lower nosepiece clamps 16 and 18 are made of strong, heat-resistant material, e.g., steel. The supporting fixture 14 and the outer casing 21 of the tundish 10 are also made of a strong heat-resistant material, e.g., steel. There is a refractory lining 23 in the tundish 10.

The gas-permeable nozzle 20 is manufactured as a wide nozzle when used for continuously casting wide slab. Wide nozzles usually comprise more than one section. The widths of these multiple side-by-side sections add up to the desired total nozzle width, corresponding to the width of the desired cast slab product—for example, more than about 10 inches (about 250 millimeters) wide. There are two (only one is shown) mirror-image side sections 22 of the nozzle, and there are add-on sections 24, which are located between these two side sections, as will be understood from FIG. 5.

Figure 5:
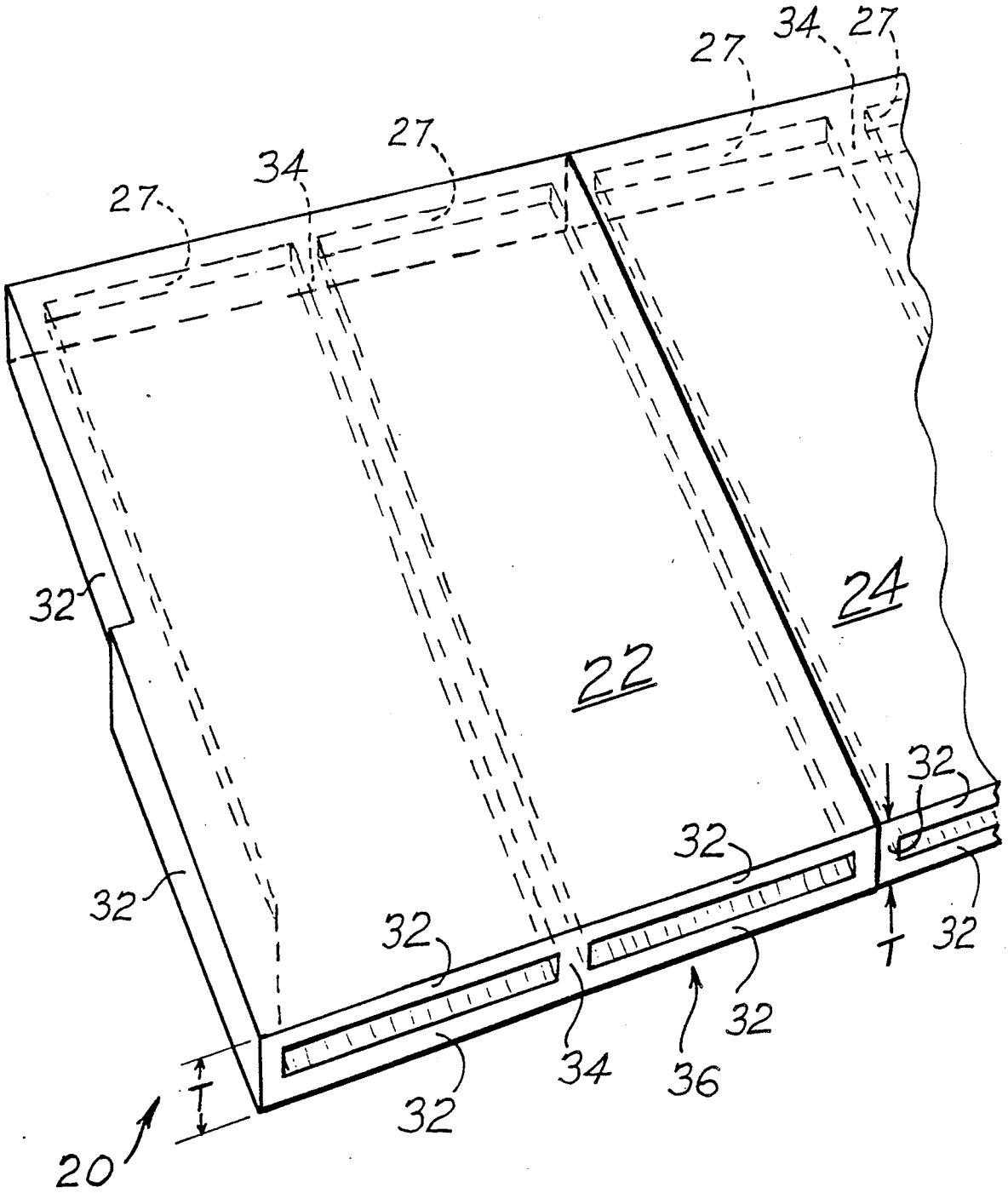
FIG. 5 is an oblique top view of a portion of a nozzle embodying the present invention. In this view, the reader is looking somewhat upstream and can see the outlet ends of molten-metal-feeding passageways which exit at the discharge (downstream) end of the nozzle.

One typical slab thickness to be twin-belt cast in aluminum alloys is about 0.600 of an inch or about 15 millimeters, though absolute limits for thickness or thinness of twin-belt continuous casting of aluminum slab are not yet known to exist. This slab-thickness dimension corresponds approximately to the thickness "T" of the nozzle 20 as shown in FIG. 5 for its sections 22 and 24.

Figure 3:
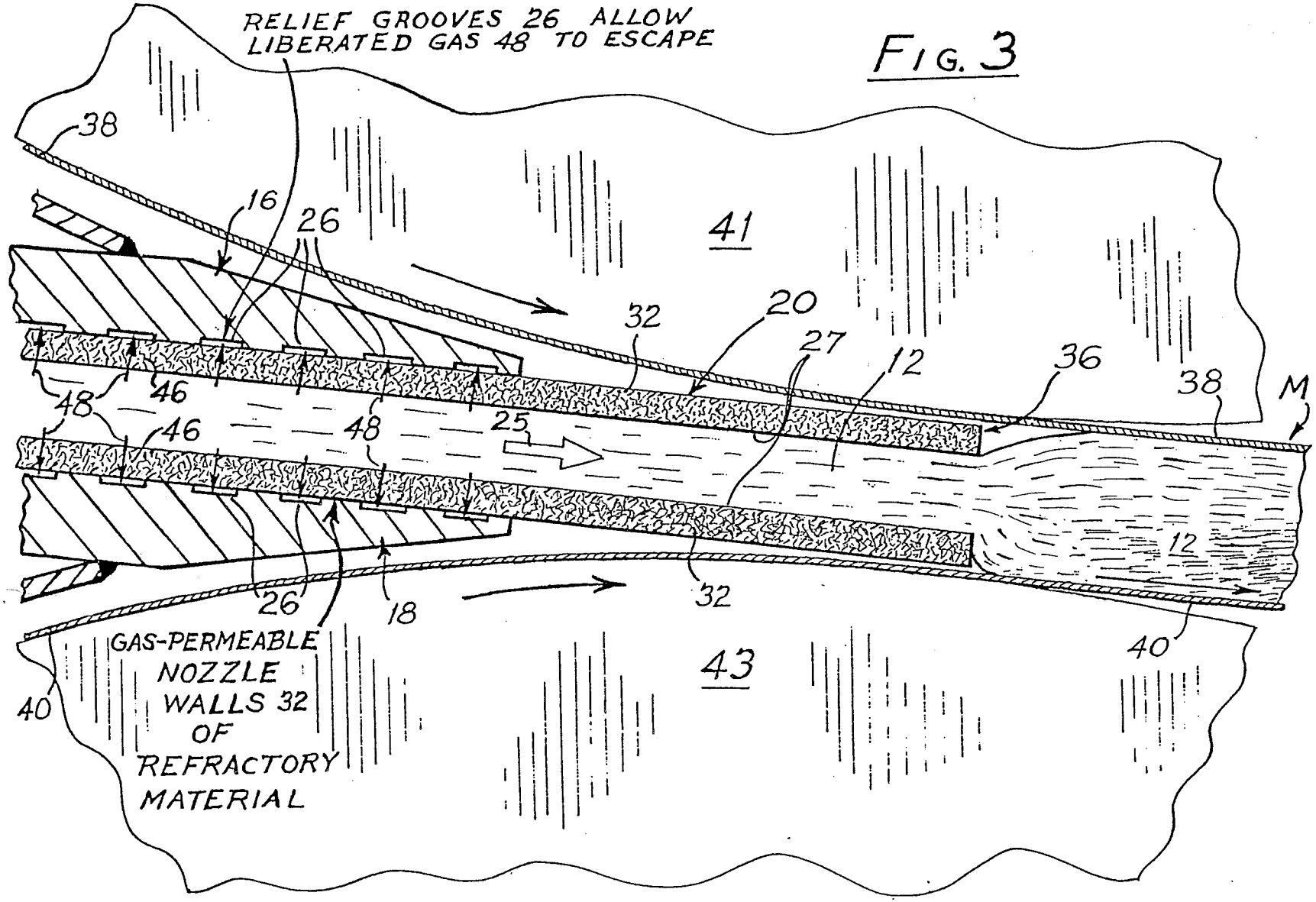
FIG. 3 is an enlarged side view of the metal-feeding elements shown in FIG. 2, with relief grooves provided for the escape of gas.
Figure 4:
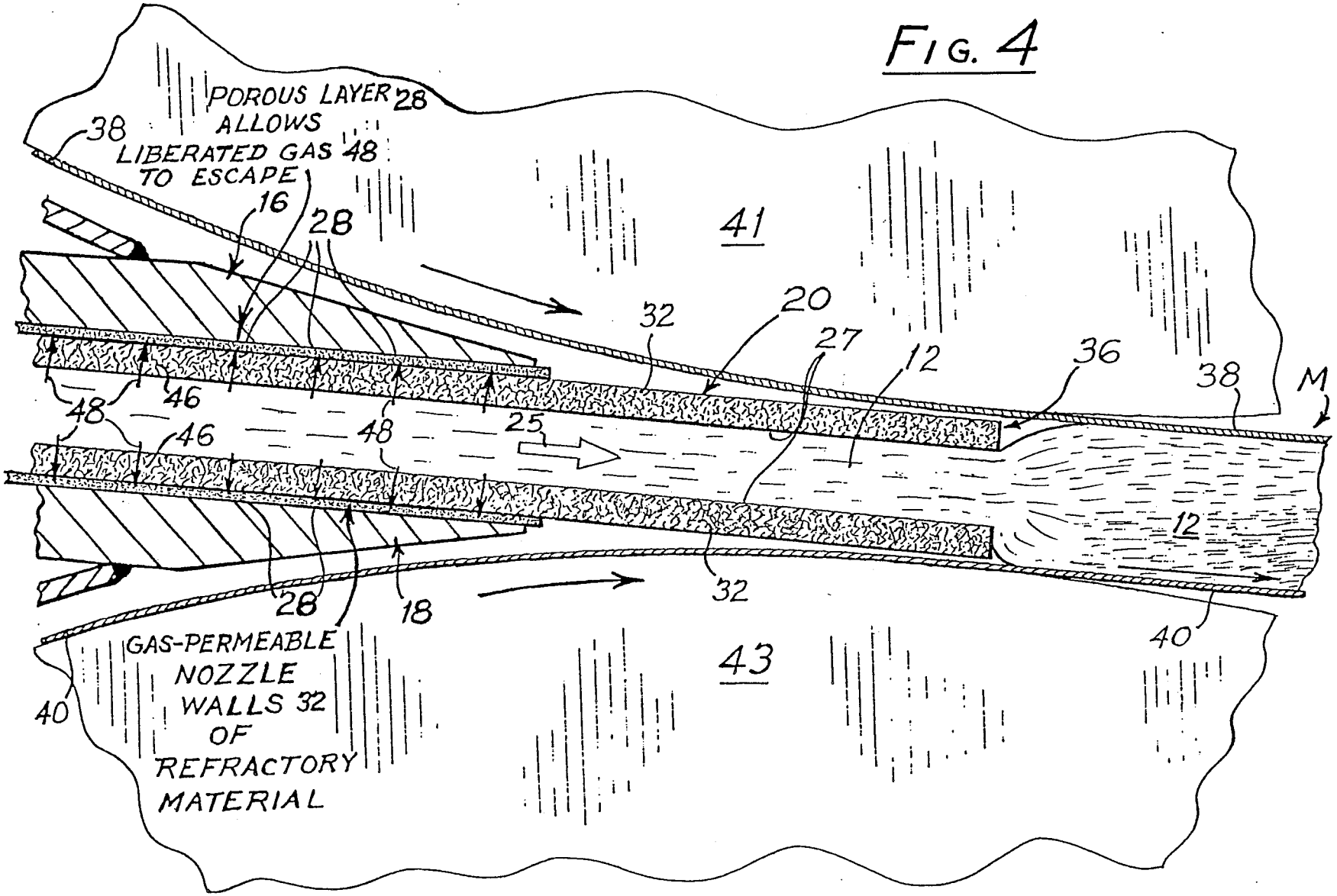
FIG. 4 is the same view as FIG. 3 but shows provision for the escape of gas by means of porous layers, instead of by relief grooves.

In order to provide means adjacent to the nozzle 20 to allow for escape of the gas liberated from the molten metal 12 flowing, as shown by arrow 25 in FIG. 3, downstream through a passageway 27 in the gas-permeable nozzle 20, there are relief grooves 26 (FIG. 3) on the clamping surfaces of the nosepieces 16 and 18 (also called nosepiece clamps) so as to afford passages for the gas evolved from the metal to escape, after this gas has passed through the permeable nozzle walls. As shown in FIG. 4, an alternative or supplemental means for allowing the liberated gas to escape is a layer 28 of porous material, for example a layer of porous material such as Fiberfrax®paper 28 of thickness about ⅛ inch (about 3 mm) (commercially available from Carborundum Co.), may be interposed between the walls of the nozzle 20 and each clamp 16 and 18. This layer 28 is thus formed of bendable, porous, heat-resistant material.

The nozzle passageways 27 for downstream flow 25 of the molten metal 12 are made as wide and high as may be consistent with the stability of the nozzle walls 32, in order to reduce turbulence of the flowing molten metal 12 as it is approaching the moving mold M. The moving mold M is defined between the moving upper belt 38 and the moving lower belt 40. Rib 34 (FIG. 5) is an internal support used to render the nozzle walls 32 stable while disturbing the downstream flow 25 of molten metal as little as possible. The discharge (downstream) end 36 of the nozzle 30 protrudes slightly into the region between the belts.

As shown in FIG. 1, the twin-belt continuous casting machine 30 includes the pair of revolving endless flexible casting belts 38 and 40. The upper belt 38 revolves around entrance and exit pulley rolls 41 and 42, respectively, while the lower belt 40 revolves around entrance and exit pulley rolls 43 and 44, respectively, so that these revolving belts define between themselves a moving mold region M which is carrying the molten metal downstream toward the right in FIG. 1 as shown by the arrows in FIG. 1.

In order to solidify this molten metal 12 in the mold region M, the casting belts are cooled as they move along this region M, as known in the art of twin-belt casters. Thus, the entering molten metal 12 freezes between the belts into a slab product P which exits at the right in FIG. 1. The twin-belt continuous casting machine 30 shown in FIG. 1 also includes a pair of laterally spaced moving edge dams (not shown) which form the walls of the two sides of the moving mold M, as known in this art. The moving mold M usually slopes downwardly somewhat in the downstream direction, as shown, such downward inclination in the downstream direction being less than 25 degrees to the horizontal. In other words, such moving mold region M is oriented in the downstream direction at a downward angle to horizontal in the range from zero degrees to less than about 25° to horizontal. The nozzle 20 fits between the moving casting belts and between these two edge dams with a clearance above, below, and on each side of no more than about 0.050 of an inch (about 1.27 mm). Usually the clearances are less than that figure, thereby providing "closed metal feeding," as discussed above in the Background.

As shown, at least that portion of the nozzle 20 which fits between the belts is sloping downwardly in the downstream direction at substantially the same angle as the moving mold M.

The refractory materials used for making the gas-permeable walls 32 of the nozzle 20 in its sectional parts 22 and 24 that are known to be successful contain one or more of the following: fibers of silica, fibers of alumina, and a boron compound. These fibers are felted, intertwined together and are cohered together in their intertwined relationship. The fibers are ceramic, strictly speaking, though the resulting gas-permeable walls 32, or the entire nozzle 20, are very different in mechanical and physical characteristics from ordinary ceramic; hence, I prefer not to use the name "ceramic" to describe the novel nozzle, nor to describe its gas-permeable walls.

A suitable material for making a nozzle 20 having gas-permeable walls 32 must be relatively non-wettable by whatever molten metal 12 is to be fed through the nozzle passageways 27. The resulting gas-permeable walls 32 have interconnected voids or interstitial porosity 46 (FIG. 3) with interconnected void interstices of such size as to be permeable to the liberated gas 48 while these interconnected interstices 46 are sufficiently small to be non-passable to the molten metal 12 being fed. Moreover, the nozzle walls 32 must retain these desired characteristics for a reasonable term of usefulness against the heat and corrosivity of the molten metal 12 flowing 25 through the passageways 27. These novel nozzle walls 32 have high thermal insulativity.

For raw material for making a nozzle 20, I have successfully shaped and used a proprietary flat refractory, gas-permeable board known as "Kaowool TBM 2240," commercially available from Thermal Ceramics Inc., Augusta, Georgia. This board contains a major volume-percentage of void space between its constituent fibers; i.e., more than 50 percent of the total volume of this board comprises interstitial voids such that the fibers and the interconnected void space interlace with each other and allow gas 48, liberated from the flowing 25 molten metal 12 to travel outwardly and escape through the interconnected porosity 46 of the nozzle walls 32. The fibers in this gas-permeable refractory board are cohered together, forming so to speak a matrix for the interconnected porous void space 46.

The general, bulk densities of the gas-permeable refractory wall material 32 in the range from about 17 to at least about 50 pounds per cubic foot appear to be appropriate. Best experimental results so far have occurred with a bulk density of the refractory wall material 32 above about 30 up to about 40 pounds per cubic foot. The advantage of this heavier material is that of greater strength, which in turn permits the use of thinner walls 32 and hence the casting of correspondingly thinner slab. (Gas-permeable refractories of higher bulk densities, up to roughly that of water, about 62 pounds per cubic foot, have not yet been tried due to such heavier gas-permeable refractory material not being readily available. I believe that gas-permeable refractories having such higher bulk density in the range from about 40 up to about 62 pounds per cubic foot will turn out to provide superior performance due to even further increases in strength.) The precise diameters of the originally highly flexible cohered fibers in such gas-permeable refractory material is not yet known by me, though microscopic inspection indicates fiber diameters in the range of about 1.5 to about 9 micrometers.

The bulk density range given above is great enough to afford desired strength for the nozzle 20 but small enough to leave the majority of the volume of the refractory material 32 as interconnected interstitial void space 46. This void space 46 insulates the molten metal against premature solidification. Also, and very important, it affords interconnected porosity or gas-permeability, enabling gas 48 evolved from the molten metal 12 flowing 25 through the nozzle passageways 27 to escape from the nozzle 20 through the nozzle walls 32 without entering the moving mold region M. The fibers of the suitable materials present under the microscope the appearance of being sintered or otherwise cohered together. At any rate, the joining of fibers into a matrix for the void space greatly increases their collective strength in the refractory material without significantly increasing their weight.

The aforesaid fibrous refractory materials afford a number of other advantages. First, these fibrous materials are readily machined to relatively precise dimensions by the use of commercially available abrading or cutting tools studded with diamond dust. Moreover, such machining is advantageously accomplished without creating surface cracks, such as sometimes occurred in the prior art. (Care must be taken to exhaust and filter all the airborne dust to remove it from the work area where such machining is done.) Alternatively, such materials may be molded to the net desired nozzle section shapes, or near to them, so as to minimize machining to final dimensions.

Second, the aforesaid fibrous materials possess a modicum of flexibility, more so than prior-art dense, non-permeable refractory nozzles, which are apt to crack when clamped between parallel rigid clamps 16 and 18. This flexibility of the porous gas-permeable refractory materials, plus their advantageously low thermal expansivity, evidently underlies their inherent thermal shock resistance and their dimensional stability under the severe thermal conditions encountered in feeding molten metal. Prior-art undesirable experience with the clamping of dense, non-permeable refractory nozzles shows that such flexibility is especially desirable in clamping of nozzles having a width in excess of about 10 inches (about 250 mm).

The high insulativity of these fibrous refractory materials is an important factor in their success in that the molten metal 12 flowing 25 through the passages 27 is thereby restrained from premature freezing in the passages.

It is believed that the present invention may be useful additionally for feeding molten metal into twin-carriage caterpillar-block continuous casting machines which define a moving mold region that does not slope downwardly in the downstream direction at an angle of inclination to horizontal so much as 25 degrees. In other words, such a moving mold region, if it slopes at all, is oriented in the downstream direction at an angle to horizontal in the range from zero degrees to less than about 25 degrees to horizontal.

RESULTS

The invention was employed most significantly in an all-day experimental cast of AA 3105 aluminum under conditions formerly resulting in gross voids of about $\frac{1}{4}$ inch (6 millimeters) in diameter. No such voids were experienced on this occasion. An unexpected bonus was improved appearance of the cast surface of the resulting slab. This experimental aluminum slab had a thickness of about 0.600 of an inch (about 15 mm) and had a width of about 16 inches (about 400 mm).

It is to be understood that the above-mentioned favorable results were obtained in conjunction with the employment of prior-art methods and apparatus to shroud with inert gas the molten aluminum that entered the moving mold through the gas-permeable nozzle described herein. This prior art inert-gas shrouding is not part of the present invention but is described in U.S. Pat. Nos. 4,593,742 and 4,648,438 of Hazelett et al., assigned to the same assignee as the present invention.

A mechanism for achieving precisely accurate close adjustment of clearances between a molten-metal-pouring nozzle and the moving mold walls of a twin-belt casting machine is described in U.S. Pat. No. 4,830,089 of Carmichael et al. The nozzle material is mentioned in column 1, line 32 therein as being ceramic. The present invention enables such conventional kinds of ceramic nozzles to be replaced with novel gas-permeable refractory nozzles, as disclosed herein. The nozzle alignment art of U.S. Pat. No. 4,830,089 is not part of the present invention. Such nozzle alignment apparatus is useful mainly in the casting of metals of higher melting point, in which preheating of metal-feeding nozzles, etc., is required to an extent that cannot be carried out next to metal casting belts.

Although the examples and observations stated herein have been the results of work with a limited number of molten metal alloys, this invention appears applicable to the continuous casting of any metal between twin belts, subject to these provisos: (1) The material used for the nozzles must reasonably endure the temperature and corrosivity encountered in use, and (2) the molten metal must not wet the gas-permeable nozzle material nor penetrate the porosity of the porous nozzle material.

Although specific presently preferred embodiments of the invention have been disclosed herein in detail, it is to be understood that these examples of the invention have been described for purposes of illustration. This disclosure is not to be construed as limiting the scope of the invention, since the described methods and apparatus may be changed in details by those skilled in the art of making and using metal-pouring nozzles in continuous casting, in order to adapt these methods to be useful in particular casting machines or situations, without departing from the scope of the following claims.

I claim:

1. A molten-metal feeding nozzle for feeding of molten metal into a twin-belt continuous metal-casting machine, said nozzle having multiple metal-feeding passageways enclosed by walls formed of refractory material, said walls of said molten-metal-feeding nozzle being characterized in that:

the refractory material of said nozzle walls is gas-permeable, having interconnected porosity of sufficient size for permitting hydrogen gas to pass therethrough, said interconnected porosity is sufficiently small for preventing passage of the molten metal from a metal-feeding passageway through an adjacent wall, said refractory material is substantially non-wettable by the molten metal, the width of said nozzle is greater than about 10 inches (about 250 mm), said nozzle is held in sandwiched relationship between clamp means, and said clamp means includes means adjacent to the nozzle allowing escape away from the nozzle of gas passing through the gas-permeable material of said nozzle walls.

2. The molten-metal-feeding nozzle as claimed in claim 1, in which:

said means adjacent to said nozzle for allowing escape away from the nozzle of gas passing through the gas-permeable refractory material of said nozzle walls include a layer of porous, bendable, heat-resistant material positioned between a wall of the nozzle and said clamp means.

3. The molten-metal-feeding nozzle as claimed in claim 2, in which:

said means adjacent to said nozzle for allowing escape away from the nozzle of gas passing through the gas-permeable refractory material of said nozzle walls include two layers of porous, bendable, heat-resistant material, one of said two layers being positioned between an upper wall of said nozzle and said clamp means, and the other of said two layers being positioned between a lower wall of said nozzle and said clamp means.

4. The molten-metal-feeding nozzle as claimed in claim 2, in which:

said layer of porous, bendable, heat-resistant material is about ⅛th of an inch (about 3 mm) thick.

5. A molten-metal-feeding nozzle for feeding molten metal into a continuous metal-casting machine having a moving mold region which is oriented downward in the downstream direction at an angle to horizontal in the range of from zero degrees to less than about 25 degrees to horizontal, said nozzle having a plurality of metal-feeding passageways extending in a downstream direction in said nozzle for feeding molten metal into said moving mold region, and said metal-feeding passageways being enclosed by walls of refractory material, characterized in that:

said refractory material of said nozzle walls is gas-permeable having interconnected porosity therein of sufficient size for permitting hydrogen gas liberated by molten metal in said passageways to pass through said nozzle walls to outside of said nozzle, said interconnected porosity does not allow passage of molten metal through said nozzle walls to outside of said nozzle, said refractory material of said nozzle walls is substantially non-wettable by the molten metal in order to avoid undesirable amounts of molten metal from solidifying in said passageways in adherent relationship to the nozzle walls, said nozzle being in sandwiched relationship between oposed supports, and means for providing for gas escape from between each of said supports and said nozzle.

6. The molten-metal-feeding nozzle as claimed in claim 5, in which:

said gas-permeable refractory material comprises cohered fibers of refractory materials, and said cohered fibers form a matrix interlaced with interconnected void space providing said interconnected porosity.

7. The molten-metal-feeding nozzle as claimed in claim 6, in which:

said gas-permeable refractory material has a bulk density in the range from about 17 to about 50 pounds per cubic foot.

8. The molten-metal-feeding nozzle as claimed in claim 6, in which:

said gas-permeable refractory material has a bulk density in the range of about 30 to about 40 pounds per cubic foot.

9. The molten-metal-feeding nozzle as claimed in claim 6, in which:

said cohered refractory fibers have apparent diameters as seen in a microscope in the range of about 1.5 to about 9 micrometers.

10. The method in continuous metal-casting for producing a continuously cast product wherein a feeding nozzle having multiple passageways enclosed by walls is used for feeding molten metal through said passageways into a moving mold defined between surfaces moving downstream at an angle to the horizontal in the range between zero degrees and about twenty-five degrees, and wherein said molten metal contains within itself a potentially troublesome amount of gas, said method comprising the steps of:

providing walls of said feeding nozzle of gas-permeable refractory material including interconnected porosity extending through said walls for allowing such gas liberated from molten metal being fed through said passageways to escape through the interconnected porosity of said walls to an exterior of said nozzle, supporting said nozzle in sandwiched relationship between opposed supports, and providing for gas escape from between each of said supports and said nozzle for allowing liberated gas which has passed through said walls to escape into ambient from the exterior of said walls.

11. The method as claimed in claim 10, including the steps of:

feeding through said passageways into said moving mold molten aluminum alloy comprising mostly aluminum by weight, and allowing hydrogen gas liberated from the molten aluminum alloy feeding through said passageways to escape from said passageways through the interconnected porosity of said walls to an exterior of said nozzle and to escape from between each support and said nozzle for allowing the hydrogen to escape away from the exterior of said walls.

12. A moltlen-metal-feeding nozzle for feeding molten metal into a continuous casting machine having a moving mold region, said nozzle comprising:

a plurality of nozzle walls of refractory material defining at least one metal-feeding passageway for feeding molten metal into said moving mold region, said nozzle having a width greater than about 10 inches (about 250 mm), said refractory material of said nozzle walls having gas permeability for allowing escape through said walls of gas liberated from molten metal flowing through said passageway, said nozzle being held in sandwiched relationship between clamp means, and said clamp means including means adjacent to nozzle walls allowing escape away from the nozzle of gas passing through the gas-permeable refractory material of said nozzle walls.

13. The molten-metal-feeding nozzle as recited in claim 12, in which:

said means adjacent to said nozzle walls for allowing escape away from the nozzle of gas passing through the gas-permeable refractory material of said nozzle walls include a layer of porous, heat-resistant material positioned between a wall of the nozzle and said clamp means.

14. The molten-metal-feeding nozzle as recited in claim 13, in which:

said means adjacent to said nozzle for allowing escape away from the nozzle of gas passing through the gas-permeable refractory material of said nozzle walls include two layers of porous heat-resistant material, one of said two layers being positioned between one wall of said nozzle and said clamp means, and the other of said two layers being positioned between an opposite wall of said nozzle and said clamp means.

15. The molten-metal-feeding nozzle as recited in claim 13, in which:

said layer of porous, heat-resistant material is about ¼th of an inch (about 3 mm) thick.

16. A molten-metal-feeding nozzle for feeding molten metal into a continuous casting machine having a moving mold region, said nozzle being characterized by:

a plurality of nozzle walls of refractory material defining at least one metal-feeding passageway for feeding molten metal into said moving mold region, said nozzle having a width greater than about 10 inches (about 250 mm), said refractory material of said nozzle walls having permeability to gas for allowing escape through said nozzle walls of gas liberated from molten metal flowing through said passageway, said nozzle being supported in sandwiched relationship between clamp means, and said clamp means having a plurality of relief grooves facing the nozzle for allowing escape away from the nozzle of gas escaping through gas-permeability of said nozzle walls.

17. The molten-metal-feeding nozzle as recited in claim 16, characterized further in that:

said nozzle walls define a plurality of metal-feeding passageways for feeding molten metal into the moving mold region, and said plurality of relief grooves extend generally at right angles to the direction of feeding of molten metal through said plurality of metal-feeding passageways.

18. The molten-metal-feeding nozzle as recited in claim 17, characterized further in that:

said nozzle walls define a plurality of metal-feeding passageways for feeding molten metal into said moving mold, and said plurality of relief grooves extend generally at right angles to the direction of feeding of molten metal through said plurality of metal-feeding passageways.

19. The molten-metal-feeding nozzle as recited in claim 16, characterized further in that:

said clamp means have a pair of opposed clamping surfaces adjacent to respective nozzle walls on opposite sides of the nozzle, and there are a plurality of relief grooves in each of said clamping surfaces.

20. The molten-metal-feeding nozzle as recited in claim 19, characterized further in that:

said nozzle walls define a plurality of metal-feeding passageways for feeding molten metal into the moving mold region, and said plurality of relief grooves in each of said clamping surfaces extend generally at right angles to the direction of feeding of molten metal through said plurality of metal-feeding passageways.

* * * * *